US005624144A

United States Patent [19]

Roche

[11] Patent Number: 5,624,144

[45] Date of Patent: Apr. 29, 1997

[54] EXCREMENT SCOOP

[76] Inventor: Mortimer P. Roche, 8516 Blounts La., Fulton, Md. 20759

[21] Appl. No.: 587,789

[22] Filed: Dec. 26, 1995

[51] Int. Cl.[6] ..... A01K 29/00; E01H 1/12

[52] U.S. Cl. ..... 294/1.3

[58] Field of Search ..... 294/1.1, 1.3, 1.4, 294/9, 19.1, 55, 50.6, 50.7, 50.8; 198/657

[56] References Cited

U.S. PATENT DOCUMENTS

| | | | |
|---|---|---|---|
| 1,644,426 | 10/1927 | Gentsch | 294/50.6 |
| 2,689,762 | 9/1954 | Krumm | 294/50.6 |
| 3,936,087 | 2/1976 | Alexander . | |
| 4,119,337 | 10/1978 | Sherhandt | 294/1.4 |
| 4,240,656 | 12/1980 | Eiffinger . | |
| 4,536,023 | 8/1985 | Sutter | 294/55 |
| 4,735,189 | 4/1988 | Murphy et al. | 294/9 |
| 5,174,620 | 12/1992 | Huegelmeyer et al. | 294/1.3 |
| 5,315,960 | 5/1994 | Lamp . | |
| 5,318,330 | 6/1994 | Dombrowski . | |
| 5,409,279 | 4/1995 | Magee . | |

FOREIGN PATENT DOCUMENTS

| | | | |
|---|---|---|---|
| 555932 | 8/1993 | European Pat. Off. | 294/1.3 |

*Primary Examiner*—Dean Kramer
*Attorney, Agent, or Firm*—Terrance L. Siemens

[57] ABSTRACT

A scoop having a screw blade housed within a cylindrical housing. The scoop is intended to remove semisold materials from the ground. A handle extending above the housing rotates the blade. Preferably, the scoop incorporates a drive for translating linear motion to rotary motion, so that the user need only press the handle downwardly when the device is placed over material to be lifted and removed. A closure closes the bottom of the housing to retain material, and is swung out of the way to expose the screw blade for deployment. Material is removed by reversing direction of the screw blade. The preferred application is enabling ready removal of excrement left by animals. When optionally combined with a retractable leash, a pet owner can conveniently observe municipal ordinances requiring animal wastes to be removed by owners walking their pets while requiring but one hand both to hold the novel scoop and to control the animal's leash.

6 Claims, 2 Drawing Sheets

EXCREMENT SCOOP

BACKGROUND OF THE INVENTION

1. Field of the Invention

The present invention relates to apparatus for lifting animal excrement from the ground and depositing the same into a receptacle. The apparatus comprises a cylindrical receptacle occupied by a screw blade. The bottom of the receptacle is moved out of the way to expose the interior. With the receptacle resting on the ground, the screw blade is rotated. The blade lifts the excrement up into the receptacle, and the bottom of the receptacle is moved back into a position closing the receptacle. The screw blade is operated by a rotatable handle extending upwardly above the cylindrical receptacle. The device can be emptied by reversing its operation, or by removing the bottom closure and allowing the contents to fall from the receptacle.

2. Description of the Prior Art

In urban and suburban settings, pet owners must periodically allow their pets a measure of freedom for exercise and elimination of wastes. Most municipalities and similar authorities have prohibited disposal of animal excrement in this manner, opting instead for requiring that the excrement be removed by the animal's owner.

This is an onerous task, since handling of and proximity to excrement is unpleasant at best. The prior art has suggested apparatus for scooping and containing excrement. U.S. Pat. No. 4,240,656, issued to Karlheinz Eiffinger on Dec. 23, 1980, describes an apparatus for this purpose wherein a multibladed shovel unfolds into a deployed position from a handle. In an alternative embodiment of the invention, a cylindrical receptacle having a removable bottom closure receives waste discharged thereinto by shovels through openings formed in the cylindrical wall of the receptacle. By contrast, the present invention employs a screw blade which does not fold down. And unlike the shovels of Eiffinger's second embodiment, the screw blade occupies the receptacle, rather than being deployed when removed from the receptacle.

U.S. Pat. No. 3,936,087, issued to William R. Alexander on Feb. 3, 1976, describes a cylindrical receptacle having an internal scraper tray which projects from one end of the cylinder. However, unlike the present invention, there is no internal screw blade.

A scooping device shown in U.S. Pat. No. 5,318,330, issued to Thaddeus Dombrowski on Jun. 7, 1994, comprises two opposed scoops which are mutually hinged and close in clamshell fashion. By contrast, the present invention comprises an outer housing having a rotating internal screw blade.

Enclosed augers are employed in transporting fluent materials, such as freshly mixed cement. Such devices lack a manual drive found in the present invention, and also lack closures at both ends of the surrounding conduit or receptacle required in the present invention.

None of the above inventions and patents, taken either singly or in combination, is seen to describe the instant invention as claimed.

SUMMARY OF THE INVENTION

The present invention provides a convenient device for both lifting and transporting animal excrement and similar semisolids. The apparatus comprises an outer cylindrical housing having a permanent closure at one end, and a movable closure at the other end. A screw blade is disposed coaxially within the cylindrical housing, and has a diameter just smaller than the interior diameter of the housing.

When deployed, the axis of the cylindrical housing and of the auger is vertical. With the movable closure removed to expose the interior of the housing, the device is lowered onto the ground above material to be removed. The screw blade is rotated, and lifts the material into the housing. The device is raised, and the movable closure is moved back into a position closing the housing. In accordance with its orientation When being employed, the open end of the cylindrical housing will hereinafter be considered the bottom end, and the opposite end will be referred to as the top end.

An advantage of the present invention is that excrement is covered immediately. Lifting the same into the receptacle occurs without the user either handling or being exposed to excrement. The material may now be temporarily stored for future disposal.

The screw blade is rotated by a handle extending outside the cylindrical housing. This blade is journaled at the closed top end of the cylinder. A motion translating drive is employed such that the handle is pushed downwardly in a linear motion. This type of drive is well known in the tool arts, being in widespread use in screwdrivers.

The drive transforms the linear thrust of the handle to rotation at the blade. This action enables a quick motion by the operator, rather than requiring tedious manual rotation of a handle or shaft. This arrangement also secures the novel device in place while in use since downward force operating the blade also pins the device against the ground.

The movable closure is swung into and out of the closed position as required. For deployment, it is opened. For transport of excrement and at other times, it is closed.

Optionally, the novel device is combined with a retractable leash assembly of the type spring biased to urge retraction of the leash. This type of device is well known to owners of pets, and usually includes a housing incorporating a grasping handle and an internal reel for paying out and retrieving leash line. It will be appreciated that the combination will afford great convenience to owners of dogs who walk their pets and must periodically collect and remove the animal's excrement, controlling the animal by a leash all the while.

Accordingly, it is a principal object of the invention to provide a device for lifting and retaining excrement.

It is another object of the invention that the operator not handle nor be exposed directly to excrement.

It is a further object of the invention to cover excrement during envelopment within the receptacle.

Still another object of the invention is to expedite action of the lifting blade.

An additional object of the invention is to pin the novel device against the ground securely when deploying the same.

It is again an object of the invention to employ a conventional drive apparatus.

Yet another object of the invention is to enable control of an animal by a leash while operating the novel device.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
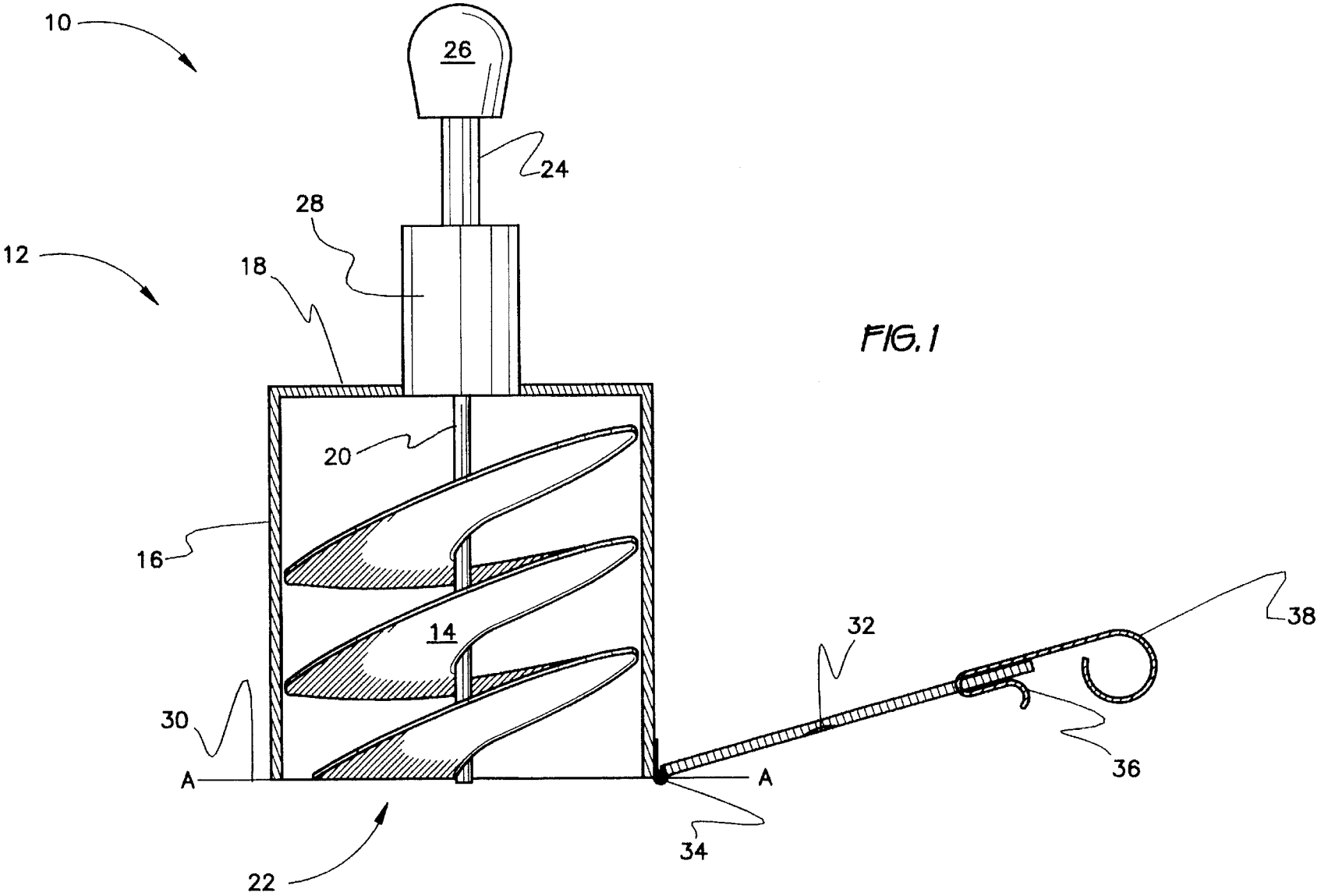
FIG. 1 is a diagrammatic, side elevational view of the invention, shown partially in cross section.

FIG. 1 shows the novel scoop 10 in its operative position. In this position, scoop 10 has been placed on the ground (not shown), over material which is to be lifted and removed from the ground. Scoop 10 comprises a cylindrical housing 12 enclosing a screw blade 14 disposed vertically within housing 12. Housing 12 comprises a lateral wall 16 and a top wall 18. Screw blade 14 has a central shaft 20 which extends upwardly through top wall 18. The open bottom end 22 of housing 12 is oriented towards the ground.

Shaft 20 is secured to and supported by housing 12 in any suitable fashion, such as being journaled within a boss (not shown) formed integrally with housing 12, or by bearings (not shown). Shaft section 24 connects to a handle 26 which is employed to rotate screw blade 14 manually. A motion translating drive is indicated at 28.

Drive 28 includes a cylinder bearing an external helical groove inscribed thereon which is occupied by a dog formed integrally with shaft section 24. When handle 26 is depressed, downward vertical motion of the dog causes the inscribed cylinder to rotate. Thus, depression of handle 26 imparts a linear input motion input into drive 28, which results in a rotary output motion. The output of drive 28 is in turn connected to shaft 20, so that screw blade 14 rotates responsive to the linear input motion initially applied to handle 26.

In a preferred embodiment, drive 28 includes apparatus for enabling reversible operation, so that screw blade 14 may be employed selectively to lift and to discharge material being collected and removed from a site. Motion translating drive and apparatus for reversing the same are well known in the art of hand tools, and will not be further described herein.

The bottom of screw blade 14 is preferably coextensive with the bottom edge 30 of housing 12. This relationship is indicated by line A—A. Screw blade 14 may terminate slightly above bottom edge 30 and line A—A, although maximal effectiveness is achieved when screw blade 14 is directly against the ground.

Figure 2:
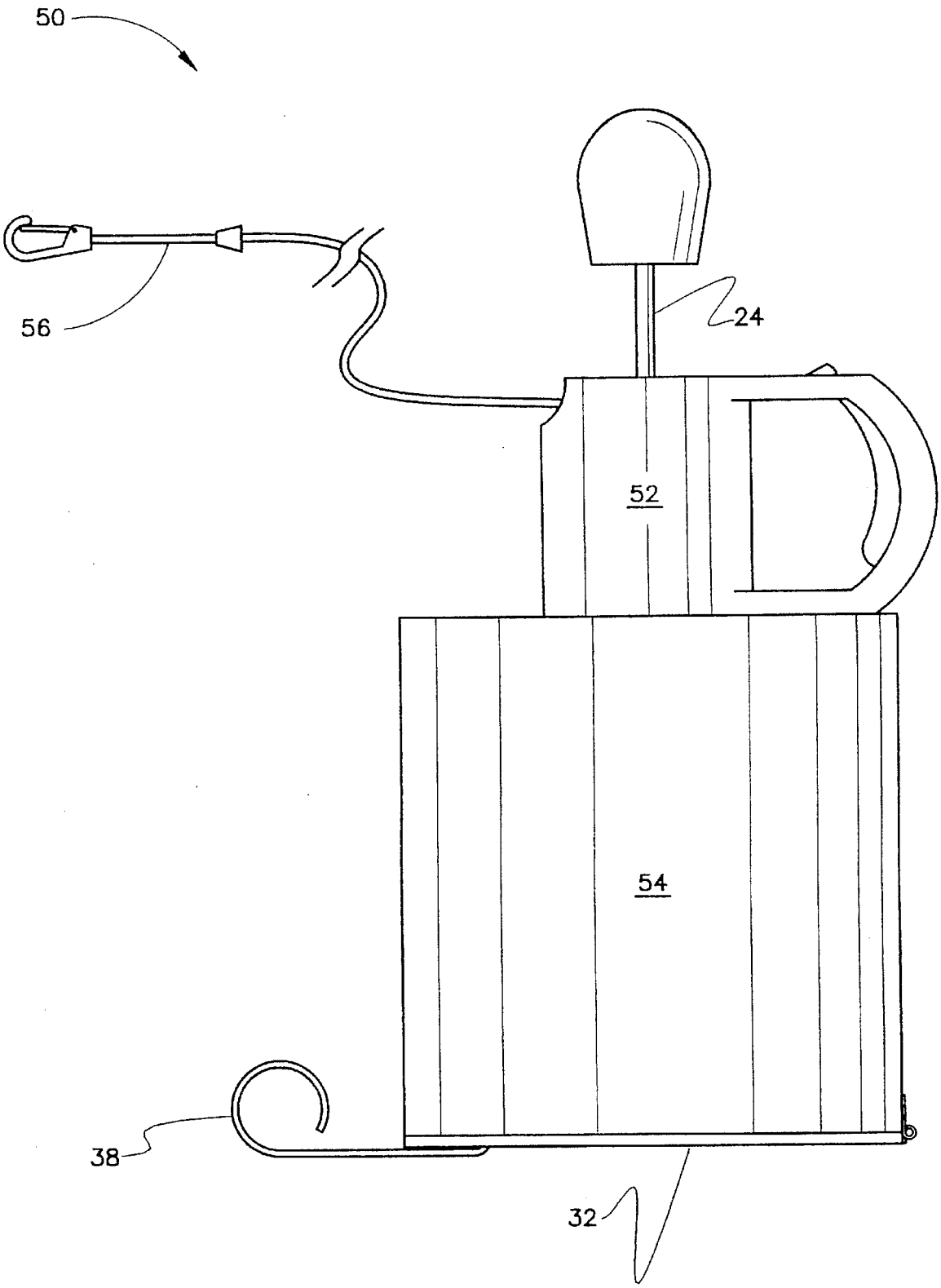
FIG. 2 is a side elevational view of an alternative embodiment of the invention.

A door or bottom closure 32 is movably attached to housing 12, for example by hinge 34. Closure 32 has a friction catch 36 causing closure 32 to bind when in the closed position, and a closure handle 38 for opening closure 32. In FIG. 1, closure 32 is illustrated in the open or deployed position, while FIG. 2 illustrates the closed position. Obviously, opening closure 32 exposes screw blade 14 for lifting or gathering material, and closing closure 32 retains this material within housing 12.

FIG. 2 illustrates an alternative embodiment of the invention wherein scoop 50 incorporates a retractable leash assembly 52 attached to housing 54. In all other respects, scoop 50 includes all apparatus and functions of scoop 10.

Incorporation of retractable leash assembly 52 enables a person operating scoop 50 to control a pet (not shown) with a leash 56 by holding scoop 50 and leash assembly 52 simultaneously. Both operations can be performed with one hand, although operating handle 26 will likely require a second hand. Nonetheless, carrying scoop 52 while maintaining leash control of the pet requires but one hand.

It will occur to one of skill in the art that the present invention is susceptible to modifications and variations to the embodiments described above. For example, drive 28 may be omitted if it is deemed acceptable to rotate screw blade 14 directly from handle 26. Also, friction catch 36 may employ a magnet (not shown) instead of friction. Closure 32 may be made to pivot in one plane instead of swinging about the axis of hinge 34.

It is to be understood that the present invention is not limited to the embodiments described above, but encompasses any and all embodiments within the scope of the following claims.

I claim:

1. A scoop for lifting and storing semisolid materials by hand, comprising:

a housing having a lateral wall having a bottom edge, a top wall, and means defining an open bottom end;

a screw blade vertically disposed within and supported by said housing, said screw blade having a central shaft passing through and extending above said top wall of said housing, said screw blade having a bottom which is coextensive with said bottom edge of said housing;

a handle for driving said screw blade connected to said central shaft above said top wall; and a bottom closure selectively movable to a deployed position and a closed position, for exposing said bottom of said screw blade and for retaining gathered material within said housing.

2. The scoop according to claim 1, further comprising a motion translating drive having means for translating a linear input motion to a rotary output motion, said handle connected to said drive so as to impart a linear motion thereto, and said drive connected in turn to said central shaft of said screw blade so as to rotate said screw blade responsive to the linear input motion applied to said handle.

3. The scoop according to claim 2, said motion translating drive having means for reversible operation, whereby said screw blade is employed both to lift and to discharge material being collected and removed.

4. A scoop for lifting and storing semisolid materials by hand, comprising:

a housing having a lateral wall having a bottom edge, a top wall, and means defining an open bottom end;

a screw blade disposed within and supported by said housing, said screw blade having a central shaft passing through and extending above said top wall of said housing; and a handle for driving said screw blade connected to said central shaft above said top wall, further comprising a retractable leash assembly attached to said scoop, whereby a pet can be controlled by a person operating said scoop.

5. A scoop for lifting and storing semisolid materials by hand, comprising:

a housing having a lateral wall having a bottom edge, a top wall, a bottom closure selectively movable to a deployed position and a closed position, for retaining gathered material within said housing, and means defining an open bottom end;

a screw blade disposed within and supported by said housing, said screw blade having a central shaft passing through and extending above said top wall of said housing, said bottom closure exposing said screw blade when said bottom closure is moved to said deployed position;

a handle for driving said screw blade connected to said central shaft above said top wall;

a motion translating drive having means for translating a linear input motion to a rotary output motion, said handle connected to said drive so as to impart a linear motion thereto, and said drive connected in turn to said central shaft of said screw blade so as to rotate said screw blade responsive to the linear input motion applied to said handle; and a retractable leash assembly attached to said scoop, whereby a pet can be controlled by a person operating said scoop.

6. The scoop according to claim 5, said motion translating drive having means for enabling reversible rotation of said screw blade.

* * * * *